US007133624B2

(12) United States Patent
Serizawa

(10) Patent No.: US 7,133,624 B2
(45) Date of Patent: Nov. 7, 2006

(54) IMAGE FORMING APPARATUS AND PROGRAM UPDATE METHOD IN THE APPARATUS

(75) Inventor: Yoji Serizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 10/886,675

(22) Filed: Jul. 9, 2004

(65) Prior Publication Data

US 2005/0008385 A1 Jan. 13, 2005

(30) Foreign Application Priority Data

Jul. 10, 2003 (JP) ..... 2003-194886

(51) Int. Cl.
*G03G 15/00* (2006.01)
*G03G 21/00* (2006.01)

(52) U.S. Cl. ..... 399/75; 717/169; 717/175

(58) Field of Classification Search ..... 399/75; 717/169, 175
See application file for complete search history.

(56) References Cited

U.S. PATENT DOCUMENTS 6,185,696 B1 * 2/2001 Noll ..... 714/6
6,952,535 B1 * 10/2005 Kawaura ..... 399/77

FOREIGN PATENT DOCUMENTS

JP 3-268139 11/1991

* cited by examiner

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

A control program is previously stored in a flash ROM, and when update of the control program stored in the flash ROM is requested, control is changed to that based on a program stored in a mask ROM, and a control program as the subject of update is received and written into the flash ROM under the control of the program stored in the mask ROM. When writing of the new control program into the flash ROM has ended and the update of the control program in the flash ROM has been completed, the control is changed to that based on the updated control program. Further, information indicating whether or not the update of the control program has been normally completed is stored in an EEPROM, and control processing is performed based on the control program stored in the flash ROM or the control program stored in the mask ROM in accordance with the information.

6 Claims, 11 Drawing Sheets

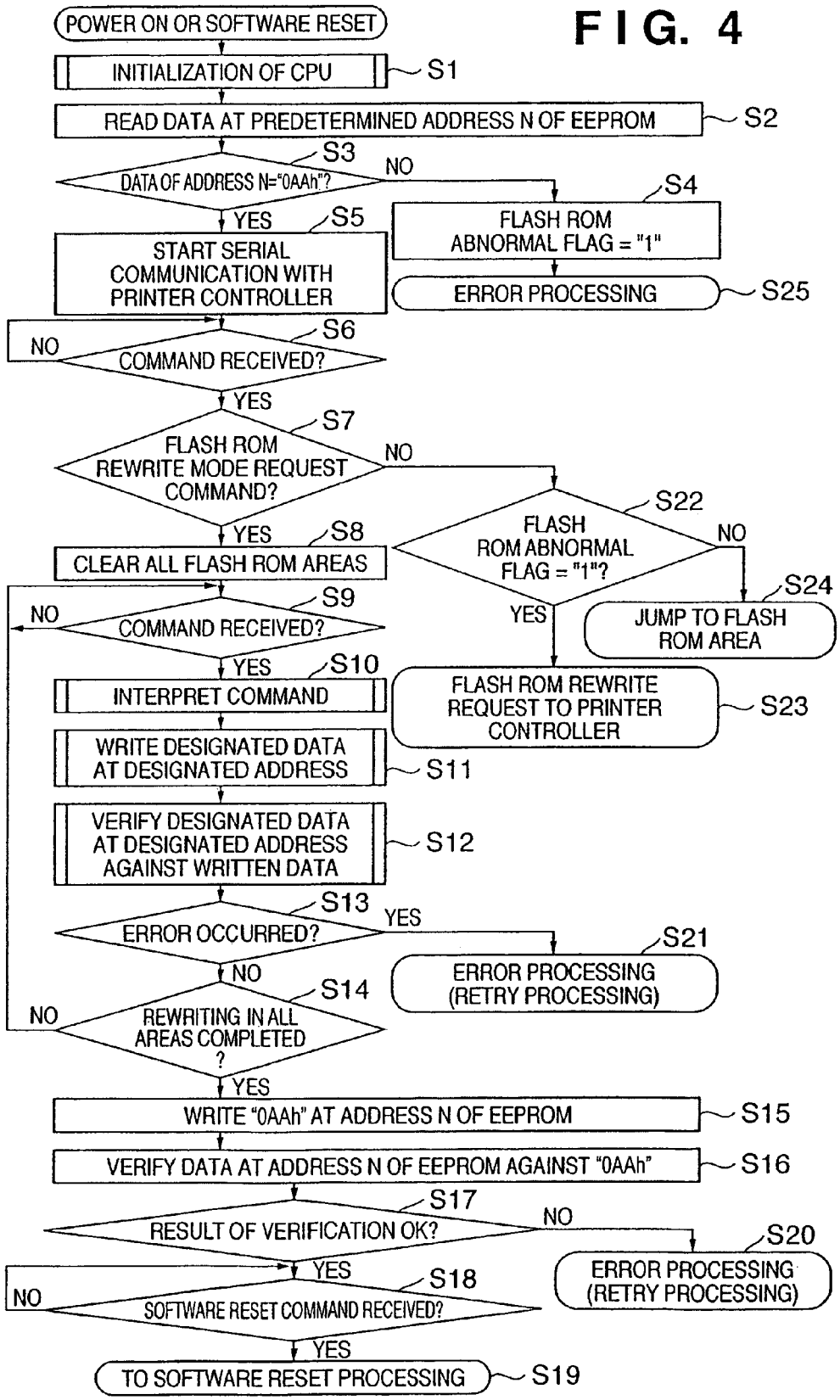
FIG. 4
POWER ON OR SOFTWARE RESET
INITIALIZATION OF CPU
S1
READ DATA AT PREDETERMINED ADDRESS N OF EEPROM
S2
S3
DATA OF ADDRESS N="0AAh"?
NO
YES
S4
FLASH ROM ABNORMAL FLAG = "1"
S5
START SERIAL COMMUNICATION WITH PRINTER CONTROLLER
ERROR PROCESSING
S25
S6
NO
COMMAND RECEIVED?
YES
S7
FLASH ROM REWRITE MODE REQUEST COMMAND?
NO
S22
FLASH ROM ABNORMAL FLAG = "1"?
NO
YES
S8
CLEAR ALL FLASH ROM AREAS
S24
JUMP TO FLASH ROM AREA
S9
NO
COMMAND RECEIVED?
YES
S10
INTERPRET COMMAND
FLASH ROM REWRITE REQUEST TO PRINTER CONTROLLER
S23
WRITE DESIGNATED DATA AT DESIGNATED ADDRESS
S11
VERIFY DESIGNATED DATA AT DESIGNATED ADDRESS AGAINST WRITTEN DATA
S12
S13
ERROR OCCURRED?
YES
S21
ERROR PROCESSING (RETRY PROCESSING)
NO
S14
NO
REWRITING IN ALL AREAS COMPLETED ?
YES
WRITE "0AAh" AT ADDRESS N OF EEPROM
S15
VERIFY DATA AT ADDRESS N OF EEPROM AGAINST "0AAh"
S16
S17
RESULT OF VERIFICATION OK?
NO
S20
ERROR PROCESSING (RETRY PROCESSING)
YES
S18
NO
SOFTWARE RESET COMMAND RECEIVED?
YES
TO SOFTWARE RESET PROCESSING
S19

FIG. 7

COMMAND DATA BITS

| Bit | CONTENTS |
|---|---|
| 1st bit (MSB) | 1(COMMAND WHERE THIS BIT IS "1" IS A FLASH ROM REWRITE COMMAND) |
| 2nd bit | COMMAND CODE 5 |
| 3rd bit | COMMAND CODE 4 |
| 4th bit | COMMAND CODE 3 |
| 5th bit | COMMAND CODE 2 |
| 6th bit | COMMAND CODE 1 |
| 7th bit | COMMAND CODE 0 |
| 8th bit | DATA 7 |
| 9th bit | DATA 6 |
| 10th bit | DATA 5 |
| 11th bit | DATA 4 |
| 12th bit | DATA 3 |
| 13th bit | DATA 2 |
| 14th bit | DATA 1 |
| 15th bit | DATA 0 |
| 16th bit (LSB) | ODD PARITY |

FIG. 8

STATUS DATA BITS

| Bit | CONTENTS |
|---|---|
| 1st bit (MSB) | 0 |
| 2nd bit | STATUS CODE 5 |
| 3rd bit | STATUS CODE 4 |
| 4th bit | STATUS CODE 3 |
| 5th bit | STATUS CODE 2 |
| 6th bit | STATUS CODE 1 |
| 7th bit | STATUS CODE 0 |
| 8th bit | DATA 7 |
| 9th bit | DATA 6 |
| 10th bit | DATA 5 |
| 11th bit | DATA 4 |
| 12th bit | DATA 3 |
| 13th bit | DATA 2 |
| 14th bit | DATA 1 |
| 15th bit | DATA 0 |
| 16th bit (LSB) | ODD PARITY |

FIG. 9

FLASH ROM REWRITE MODE COMMAND/STATUS

| COMMAND NAME | COMMAND CODE (6bit) | CONTENT OF COMMAND | STATUS NAME | RETURN STATUS CODE(6bit) | CONTENT OF STATUS DATA |
|---|---|---|---|---|---|
| CMD 0 | 000000 | DESIGNATION 1 FOR TRANSITION TO FLASH ROM REWRITE MODE | STS 0 | 000000 | 00000000 |
| CMD 1 | 000001 | DESIGNATION 2 FOR TRANSITION TO FLASH ROM REWRITE MODE | STS 1 | 000001 | 00000000 |
| CMD 2 | 000010 | DESIGNATION 3 FOR TRANSITION TO FLASH ROM REWRITE MODE | STS 2 | 000010 | 00000000 |
| CMD 3 | 000011 | No Operation | STS 3 | 000011 | 00000000 |
| CMD 4 | 000100 | DESIGNATION OF READ ADDRESS HIGHER 8 BITS | STS 4 | 000100 | DESIGNATED ADDRESS HIGHER 8 BITS |
| CMD 5 | 000101 | DESIGNATION OF READ ADDRESS LOWER 8 BITS | STS 5 | 000101 | DESIGNATED ADDRESS LOWER 8 BITS |
| CMD 6 | 000110 | READ DATA REQUEST | STS 6 | 000110 | DESIGNATED ADDRESS 8 BIT DATA |
| CMD 7 | 000111 | DESIGNATION OF WRITE ADDRESS HIGHER 8 BITS | STS 7 | 000111 | DESIGNATED ADDRESS HIGHER 8 BITS |
| CMD 8 | 001000 | DESIGNATION OF WRITE ADDRESS LOWER 8 BITS | STS 8 | 001000 | DESIGNATED ADDRESS LOWER 8 BITS |
| CMD 9 | 001001 | DESIGNATION OF WRITE DATA 8 BITS | STS 9 | 001001 | DESIGNATED WRITE DATA 8 BITS |
| CMD 10 | 001010 | VERIFY REQUEST OF WRITE DATA | STS 10 | 001010 | DESIGNATED ADDRESS 8 BIT DATA |
| CMD 11 | 001011 | REQUEST FOR RATE(%) OF WRITTEN ADDRESSES | STS 11 | 001011 | RATE(%) OF WRITTEN ADDRESSES |
| ⋮ | ⋮ | ⋮ | ⋮ | ⋮ | ⋮ |
| CMD 63 | 111111 | REQUEST FOR ENGINE SOFTWARE RESET | STS 63 | 111111 | 00000000 |

IMAGE FORMING APPARATUS AND PROGRAM UPDATE METHOD IN THE APPARATUS

CLAIM OF PRIORITY

This application claims priority from Japanese Patent Application No. 2003-194886 filed on Jul. 10, 2003, the entire contents of which are incorporated herein by reference.

FIELD OF THE INVENTION

The present invention relates to an image forming apparatus in which a control program is stored in a rewritable nonvolatile memory and a program update method in the apparatus.

BACKGROUND OF THE INVENTION

Conventionally known is an electrophotographic printer which performs printing by modulating laser light in correspondence with an image signal then forming an electrostatic latent image with the modulated laser light and transferring a toner image onto a print sheet. A controller to control the operation of the printer is provided with a CPU such as microcomputer and a ROM holding a control program for the CPU and various data. As the ROM, a mask ROM is used for the sake of advantage in the cost of production.

The mask ROM is a low price device and appropriate for mass production. However, in a case where the control program stored in the mask ROM is somewhat changed due to, for example a change of specification of the apparatus, it is necessary to discard all the mask ROM and develop a mask ROM holding a new control program. This wastefulness is caused by the change of specification and it requires much time for development of new apparatus. For such reason, the conventional art cannot support diverse requirements from the market in a flexible manner.

SUMMARY OF THE INVENTION

The present invention has been made in consideration of the above conventional art, and provides an image forming apparatus in which a control program to control an image forming operation is stored in a rewritable nonvolatile memory such that the control program can be updated with a program stored in another nonvolatile memory, and a program update method in the apparatus.

Further, according to an aspect of the present invention, provided is an image forming apparatus, in which information indicating whether or not a control program is currently being updated and information indicating whether or not updating of the control program has been normally completed are previously stored, and which can prevent an malfunction due to startup of control program during updating or startup of not normally-updated control program, and a program update method in the apparatus.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a flowchart showing flash ROM rewrite processing in the engine controller according to the first embodiment;

FIG. 7 depicts a table showing command data bits in the serial communication between the printer controller and the engine controller according to the third embodiment;

FIG. 8 depicts a table showing status data bits in the serial communication between the printer controller and the engine controller according to the third embodiment;

FIG. 9 depicts a table showing command/status data in a flash ROM rewrite mode according to the third embodiment;

DETAILED DESCRIPTION OF THE PREFERRED EMBODIMENTS

Hereinbelow, preferred embodiments of the present invention will now be described in detail in accordance with the accompanying drawings.

[First Embodiment]

Figure 1:
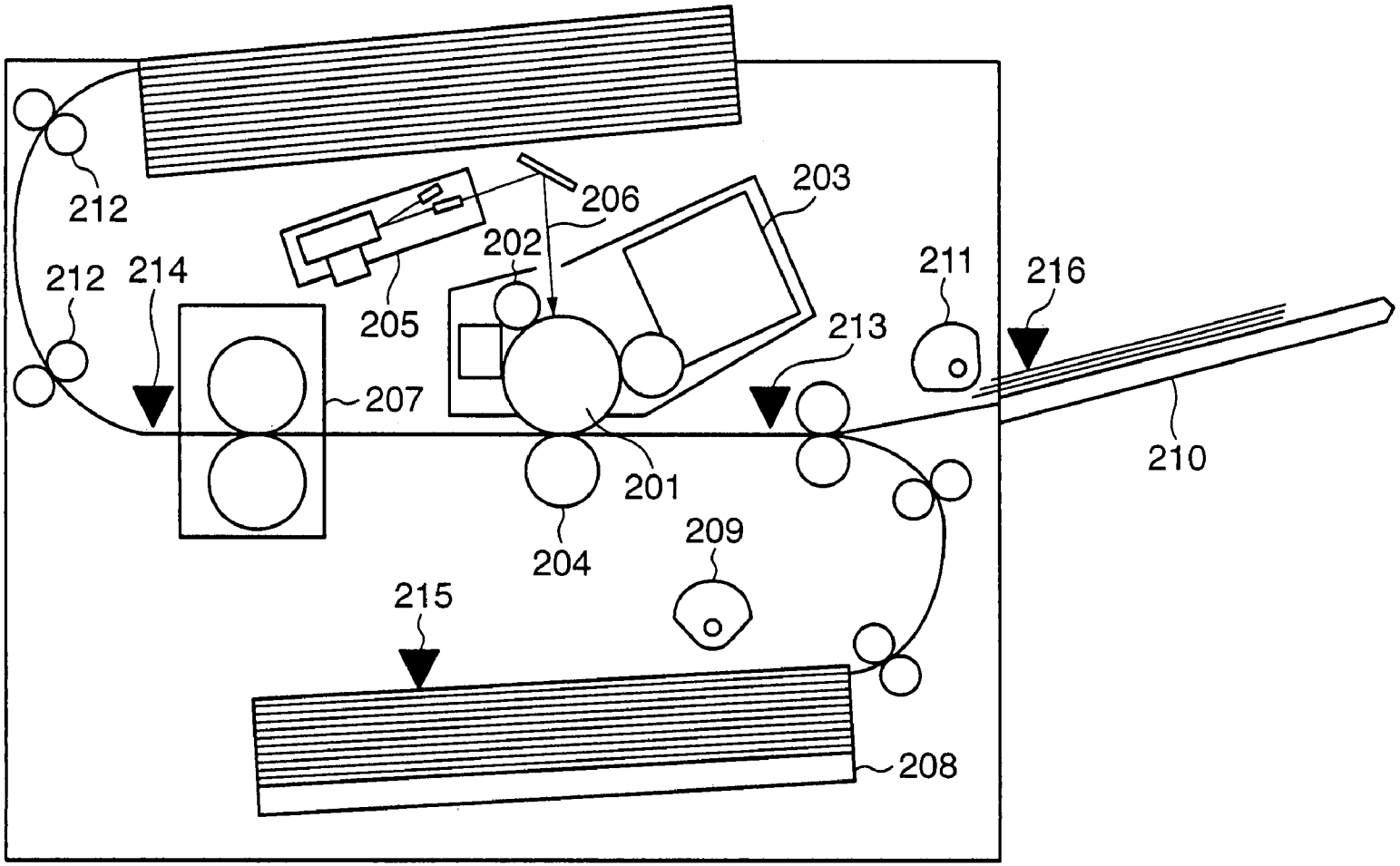
FIG. 1 depicts a schematic cross sectional view of a laser beam printer according to a first embodiment of the present invention.

FIG. 1 depicts a schematic cross sectional view of mechanical components of an electrophotographic printer as an example of an image forming apparatus according to a first embodiment of the present invention.

In FIG. 1, reference numeral 201 denotes an electrostatic drum on which an electrostatic latent image is formed by irradiation of laser light; numeral 202 denotes an electric charging roller to uniformly charge the surface of the electrostatic drum 201; numeral 203 denotes a developer to develop the electrostatic latent image on the electrostatic drum 201 to a toner image; numeral 204 denotes a transfer roller to transfer the toner image on the electrostatic drum 201 developed by the developer 203 onto a print sheet; numeral 205 denotes an optical unit to scan a laser beam 206 on the electrostatic drum 201; numeral 207 denotes a fixer to fuse toner of the toner image on the print sheet to fix the toner image to the print sheet; numeral 208 denotes a paper cassette holding print sheets; numeral 209 denotes a pick up roller to pick up a print sheet from the paper cassette 208; numeral 210 denotes a manual feed tray; numeral 211 denotes a manual feed roller to convey a print sheet fed from the manual feed tray 210; numeral 212 denotes a discharge roller to discharge the print sheet on which the image has been transferred and fixed with the fixer 207 to the outside of the apparatus; numeral 213 denotes a resist sensor to detect an end of conveyed print sheet for printing; numeral 214 denotes a paper discharge sensor to check whether or not a print sheet has been normally passed through the fixer 207 and discharged; numeral 215 denotes a paper sensor to detect presence/absence of print sheet on the paper cassette 208; and numeral 216 denotes a sensor to detect presence/absence of print sheet on the manual feed tray 210.

Figure 2:
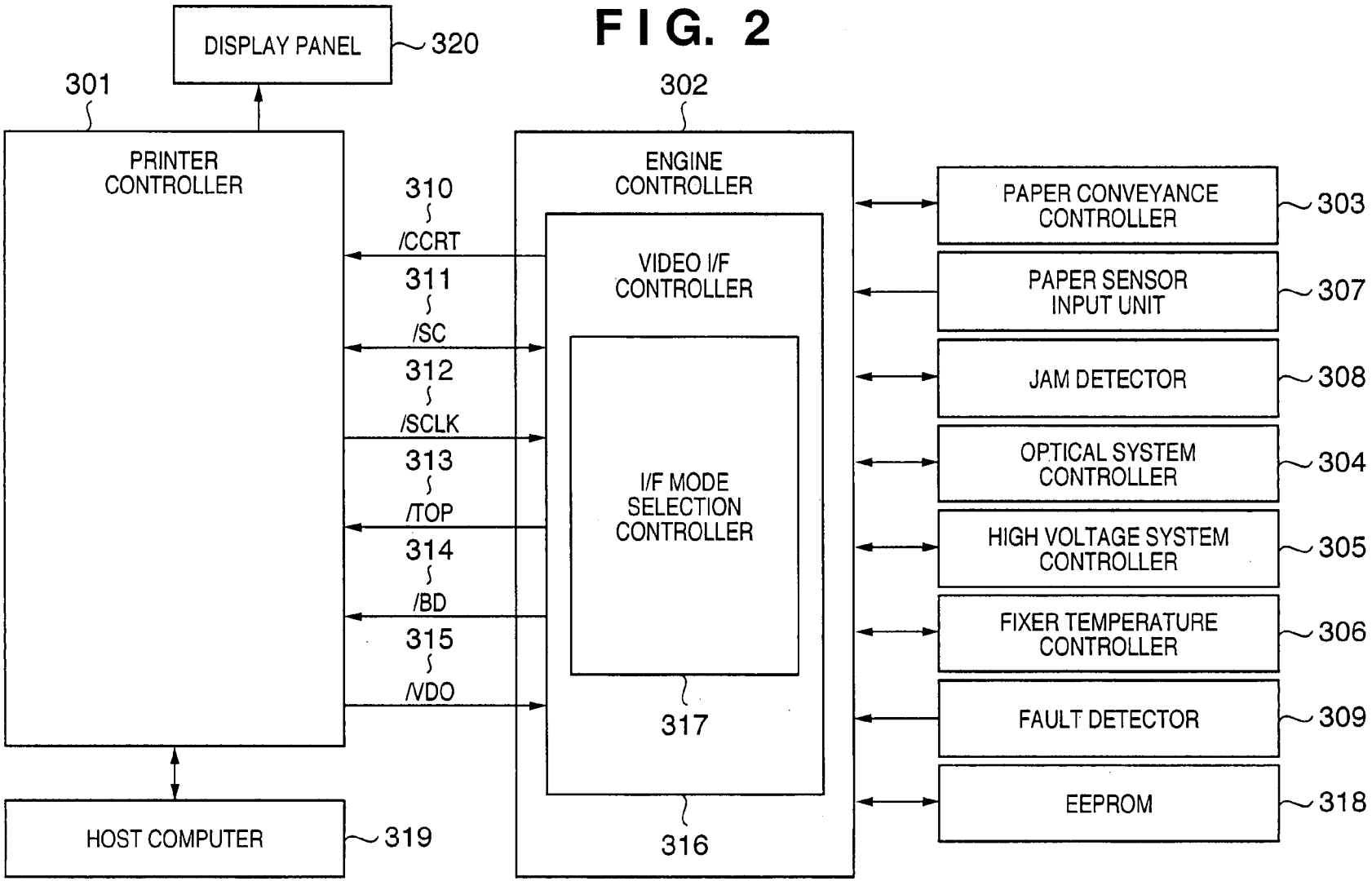
FIG. 2 is a block diagram showing the functional construction of the printer according to the first embodiment.

The operations of the respective components in FIG. 1 are controlled based on instructions from a printer controller 301 (FIG. 2).

FIG. 2 is a block diagram showing the functional construction of the electrophotographic printer according to the first embodiment. Information transmission/reception between the printer controller 301 and an engine controller 302 to control a printer engine (including the mechanical components in FIG. 1) is performed by a video interface controller 316.

The printer controller 301 controls communication with a host computer 319 as an external device, image data reception processing, and conversion of received image data to printable information for the printer engine, and the like. Further, the printer controller 301 performs signal transmission and serial communication with the engine controller 302 to be described later. The printer controller 301 is connected to a display panel 320. Information from the engine controller 302, obtained by serial communication, is displayed on the display panel 320 for a user. The engine controller 302 performs signal transmission with the printer controller 301, and controls the respective units of the printer engine via serial communication.

Next, the respective units connected to the engine controller 302 will be described.

A paper conveyance controller 303 to convey a print sheet performs paper conveyance and discharging after printing in accordance with an instruction from the engine controller 302. An optical system controller 304 performs rotation drive of a scanner motor of an optical unit 205 and laser ON/OFF control in accordance with an instruction from the engine controller 302. A high voltage system controller 305 outputs a high voltage necessary for electrophotographic process including electric charging, development and transfer in accordance with an instruction from the engine controller 302. A fixer temperature controller 306 performs temperature control on the fixer 207 in accordance with an instruction from the engine controller 302 and detects an abnormality in the fixer 207. A paper sensor input unit 307 transmits information from paper presence/absence sensors in paper feeding portions and paper conveyance path to the engine controller 302. A jam detector 308 detects a conveyance failure of print sheet during conveyance. A fault detector 309 detects a fault in the functional units in the printer.

Next, the signals between the printer controller 301 and the engine controller 302 will be described.

A /CCRT signal 310 is a status change signal to notify a status change in the printer engine from the engine controller 302 to the printer controller 301. A /SC signal 311 is a command/status signal in serial communication for bidirectional transmission of command outputted from the printer controller 301 to the engine controller 302 and status outputted from the engine controller 302 to the printer controller 301 (See FIG. 6). A /SCLK signal 312 as a serial clock is a synchronizing signal for synchronized transfer of command and status. A /TOP signal 313 is outputted from the engine controller 302 to the printer controller 301 for vertical synchronization upon arrival of print sheet at the resist sensor 213. A /BD signal 314 as a horizontal synchronizing signal is outputted in synchronization with a beam scanned by each surface of rotating polygon mirror. An image signal (/VDO) 315 is outputted from the printer controller 301 to the engine controller 302. Note that in the above signal names, "/" means that the signal is a negative logic (low-true) signal.

The video interface controller 316, existing in the engine controller 302, judges a serial communication command from the printer controller 301, and if the command designates transition to a video interface signal check mode, causes the printer engine to enter the special mode, for example via I/F mode selection controller 317, and checks respective signals on the video interface. The host computer 319 instructs the printer controller 301 to enter the video interface check mode, and transmits image code data to the printer controller 301. An EEPROM 318 is an electrically rewritable nonvolatile memory from/to which the engine controller 302 can directly read/write data. The EEPROM 318 is set such that upon rewriting of a flash ROM 354 (FIG. 3) including a control program for the engine controller 302, a predetermined bit of the EEPROM 318 is cleared immediately before start of rewriting so as to indicate that the rewriting of the flash ROM 354 is commenced. Further, in a case where the rewriting of the flash ROM 354 has been normally completed, the predetermined bit is set. The predetermined bit of the EEPROM 318 is, therefore, always set in an engine control mode upon normal printing.

Figure 3:
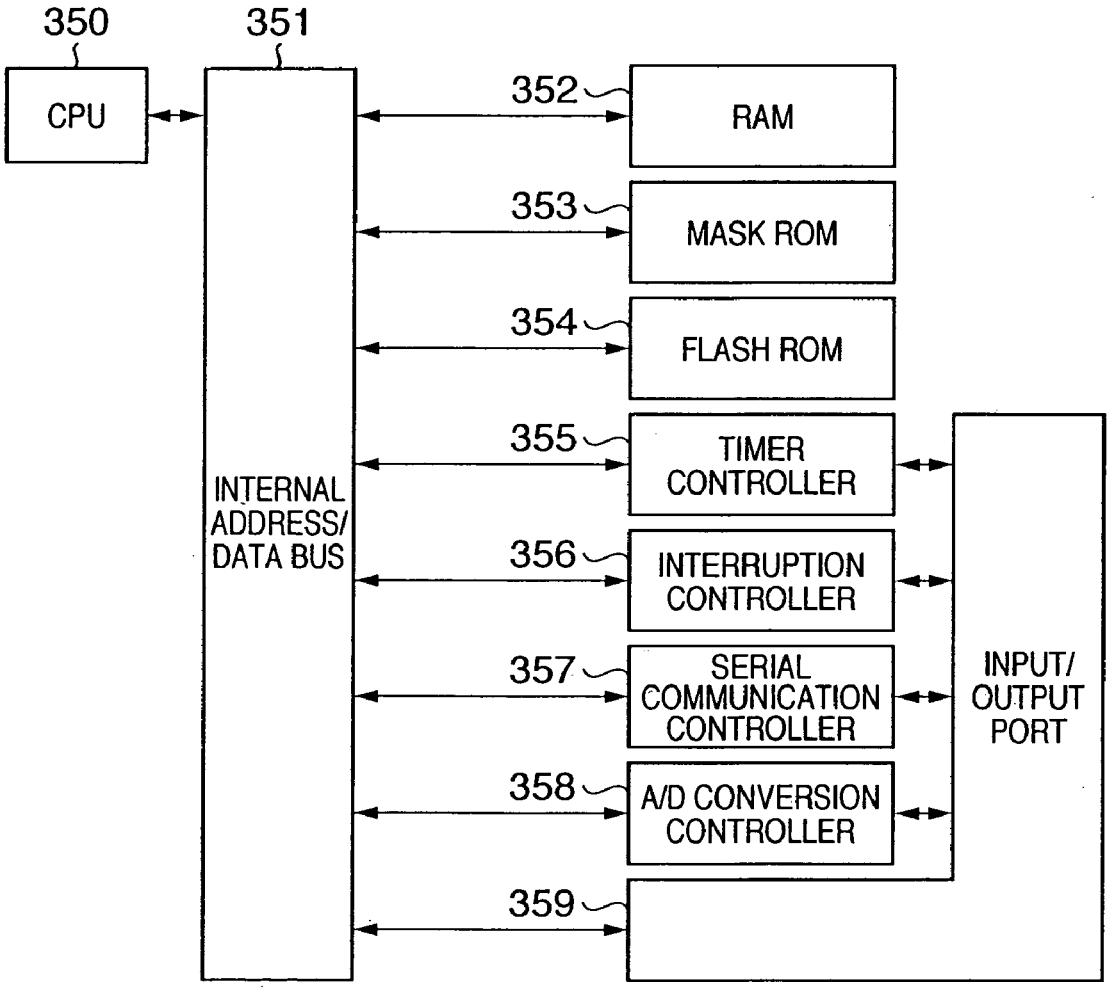
FIG. 3 is a block diagram showing the functional construction of an engine controller according to the first embodiment of the present invention.

FIG. 3 is a block diagram showing the detailed functional construction of the engine controller 302 according to the present embodiment.

A CPU 350 controls various functions via an internal address/data bus 351. The internal address/data bus 351 connects the CPU 350 with the respective units. A RAM 352 temporarily holds flag and data to be read/written based on programs stored in a mask ROM 353 and a flash ROM 354 both to be described later. In the present embodiment, a program for rewriting of the flash ROM 354, and a program (fixed) to determine based on data in the EEPROM 318 whether or not data in the flash ROM 354 have been normally rewritten and to perform serial communication with the printer controller 301, are previously stored in the area of the mask ROM 353. On the other hand, a program for engine control upon normal printer operation is stored in the flash ROM 354. The flash ROM 354 further has a function of, upon reception of a request command for transition to a flash ROM 354 rewrite mode to be described later from the printer controller 301, causing the program to jump to the above-described area in the mask ROM 353. That is, even during normal printing operation, when a request for rewriting of the flash ROM 354 is received from the printer controller 301, all the output from the various I/Os such as fixer temperature, motor, scanner and high voltage outputs are turned OFF, then control is changed to that based on the program stored in the mask ROM 353 and the flash ROM 354 control program rewrite mode is set.

A timer controller 355 has a function of presenting time in a case where accurate time management is required for electrophotographic processes regarding paper feed timing upon paper conveyance, high-voltage application timing and the like. The timer controller 355 is connected to the CPU 350 via the address/data bus 351. An interruption controller 356 reads an external input signal requiring urgent attention as an external interrupt signal, and processes various internal events. The interruption controller 356 is connected to the CPU 350 via the address/data bus 351. A serial communication controller 357 performs serial data reception/transmission in the above described serial communication with the printer controller 301. An analog/digital conversion controller 358 inputs various analog data such as the temperature of the fixer 207 and the quantity of laser light, converts them to digital signals and transmits the signals to the CPU 350. The analog/digital conversion controller 358 is connected to the CPU 350 via the internal address/data bus 351. Address/data bus 351, timer controller 355, interruption controller 356, serial communication controller 357 and analog/digital conversion controller 358 are connected to input/output port 359.

In the above construction, processing performed by the program stored in the mask ROM area 353 is executed in accordance with a flowchart as shown in FIG. 4 and thus rewriting of the control program in the flash ROM 354 is performed.

First, the program in the mask ROM 353 is started by power-on, a command from the printer controller 301, or a software reset request by a hardware signal.

In the program in the mask ROM 353, first, a step S1, the CPU 350 is initialized and output signals from various actuators and the like are set to initial states. In step S2 immediately after the initialization, data at a predetermined address (address "N") of the EEPROM 318 is fetched, and it is determined whether or not the value of the data is "0AAh" ("h" indicates a hexadecimal number). The value "0AAh" is written at the address "N" of the EEPROM 318 when the rewriting of the flash ROM 354 has been successfully completed. If the value of the data is not this value "0AAh", since there is a possibility that the rewriting of the control program in the flash ROM 354 has been suspended or failed due to some cause, the process proceeds to step S4, at which an abnormal flag of the flash ROM 354 (stored in the EEPROM 318) is turned ON. Then the process proceeds to step S25, at which error processing is performed. That is, in a case where the rewrite request has not been transmitted from the printer controller 301, a status to request rewrite of the control program is the flash ROM 354 is returned from the engine controller 302 to the printer controller 301 by serial communication. The printer controller 301 determines from the status that there is a possibility that an abnormal condition has occurred in the flash ROM 354, and displays a message to urge a user to rewrite the control program in the flash ROM 354 on the display panel 320.

It is determined at step S3 that the data "0AAh" is written at the address "N" of the EEPROM 318 (at normal operation time), the process proceeds to step S5, at which it is determined that the control program in the flash ROM 354 is normal, then serial communication with the printer controller 301 is started and a command is received (step S6). Then at step S7, it is determined whether or not the command is a request for rewriting of the flash ROM 354. If YES, the process proceeds to step S8 to enter the flash ROM 354 control program rewrite mode, while if NO, proceeds to step S22 to move to a normal printer operation mode.

In a case where the process enters the flash ROM 354 control program rewrite mode, all the areas of the flash ROM 354 are cleared at step S8. Next, at step S9, when a command has been received from the printer controller 301, the command is temporarily stored in the RAM 352 and the process proceeds to step S10, at which the command is interpreted. Then at step S11, data at predetermined addresses are sequentially written into respective addresses of the flash ROM 354 in accordance with the content of the command. In this manner, a control program sent from the printer controller 301 can be sequentially written to corresponding addresses of the flash ROM 354. Then the process proceeds to step S12, at which the written data (control program) is read again, and is verified against the received data stored in the RAM 352 (control program). As a result of the verify operation, if it is determined that some abnormality has occurred at step S13, the process proceeds to step S21, at which the same data (control program) is written and the verify operation is performed again. If some abnormality has occurred again, it is determined that some abnormal condition has occurred in the flash ROM 354 itself, and the abnormality is notified to the printer controller 301.

If it is determined at step S13 that no error has occurred, the process proceeds to step S14, at which it is determined whether or not the rewriting at all the addresses has been completed. If it is determined that the rewriting has not been completed, the process returns to step S9, at which rewriting of the program and verify operation are performed (S12). Then when it is determined at step S14 that the rewriting at all the addresses of the flash ROM 354 has been completed, the process proceeds to step S15, at which the completion of rewriting is notified to the printer controller 301 and the data "0AAh" indicating the completion of rewriting is written to the address "N" of the EEPROM 318. Then at step S16, the data at the address "N" is read, and if it is determined in step S17 that the value of the data is "0AAh", the process proceeds to step S18. If this checking processing has failed, the process proceeds to step S20, at which retry processing is performed and if OK, the process proceeds to step S18, otherwise, the failure is notified to the printer controller 301 and error processing is performed. If the data is normally written to the address "N" of the EEPROM 318, the process proceeds to step S18, at which the user's power-off/on is waited, or the current status is maintained until a software reset request is received from the printer controller 301.

Note that from the viewpoint of usability, it is desirable that upon completion of rewriting, software reset is automatically performed and a normal printing operation is started without the user's instruction. When the reset command has been received at step S18, the process proceeds to step S19, at which reset processing is performed.

Further, if it is determined at step S7 that the received command is not a request for rewriting of the flash ROM 354, the process proceeds to step S22, at which it is determined whether or not the abnormal flag of the flash ROM 354 written into the EEPROM 318 at step S4 is ON. If YES, the process proceeds to step S23, at which the printer controller 301 is requested to rewrite the flash ROM 354. Further, if it is determined at step S22 that the abnormal flag of the flash ROM 354 is OFF, the process proceeds to step S24, at which the process jumps to the control program stored in the flash ROM 354. Thus image forming processing according to the control program stored in the flash ROM 354 is performed.

As described above, the program for flash ROM 354 update processing, a program for reception of data from the printer controller 301 and the like, are fixedly written in the mask ROM 353, and a control program for the engine controller 302 is variably stored in the flash ROM 354. In this arrangement, the control program stored in the flash ROM 354 can be updated in accordance with necessity. Further, as information indicating the completion of rewriting of the control program in the flash ROM 354 is written in the EEPROM 318, it can be determined based on the information whether or not the control program has been normally stored in the flash ROM 314. This contributes to improvement of reliability of the printer.

[Second Embodiment]

Next, an example where the data indicating the completion of flash ROM control program update is stored, not in the nonvolatile memory (EEPROM) as in the case of the first embodiment, but in a predetermined area of a flash ROM 361 (FIG. 5), will be described as a second embodiment.

Further, the rewrite program is held at a predetermined address area in the flash ROM 361 in place of the mask ROM 353. The flash ROM 361 is divided in sectors by a predetermined area. In the second embodiment, the ROM area is divided by 8 Kbytes.

Upon rewriting of the flash ROM 361, flashing and then rewriting can be made by sector. Accordingly, a program corresponding to that in the mask ROM 353 as in the case of the first embodiment is written in a predetermined sector, and this area is defined as unrewritable area upon rewriting of the flash ROM 361. Further, data indicating the completion of rewriting of the flash ROM 361 corresponding to the EEPROM 318 of the first embodiment is written in another predetermined sector. In this arrangement, similar processing to that of the first embodiment can be performed without using another memory.

Figure 5:
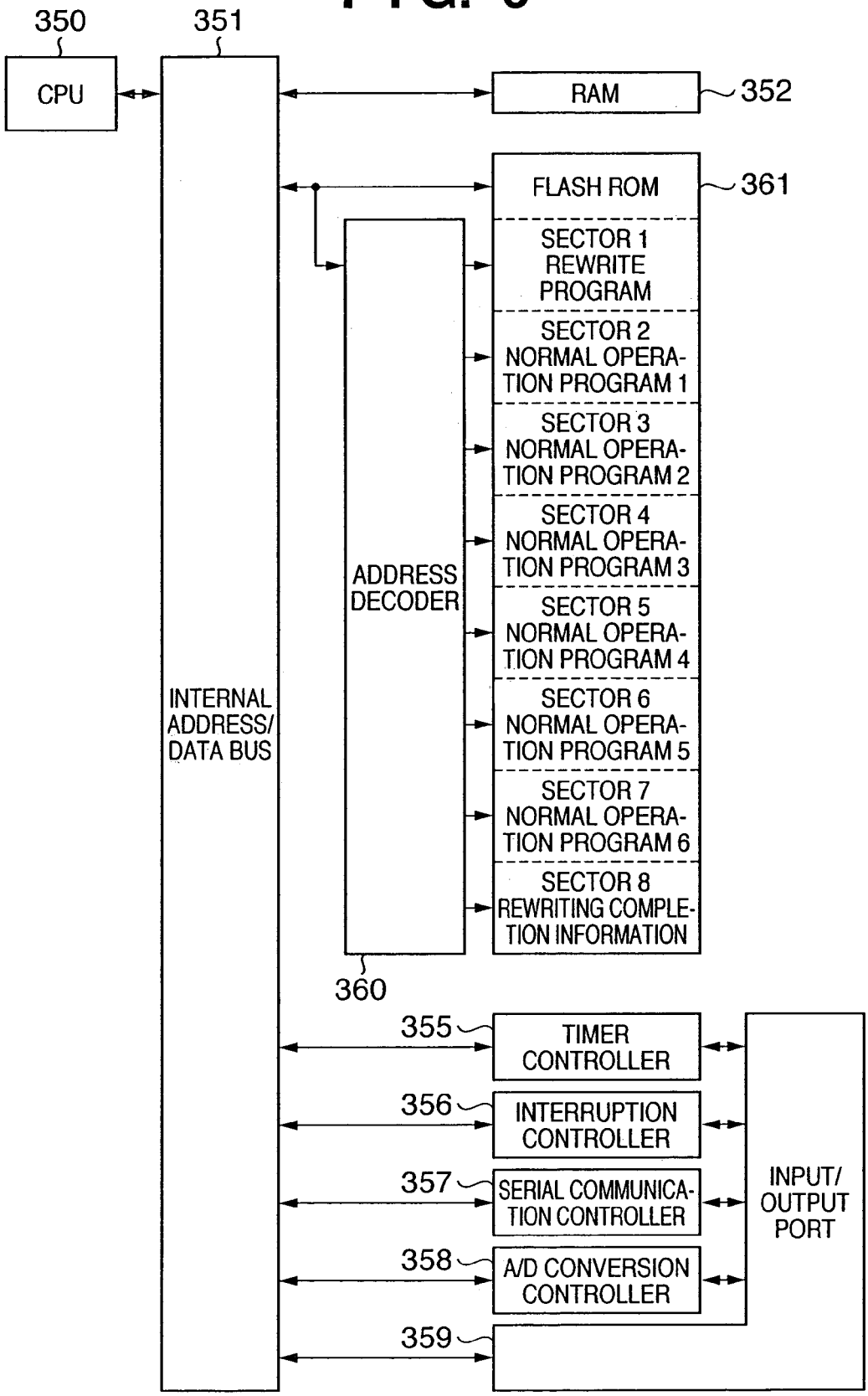
FIG. 5 is a block diagram showing the functional construction of the engine controller according to a second embodiment of the present invention.

FIG. 5 depicts functional blocks around the CPU 350 of the engine controller 302 according to the second embodiment. Note that in FIG. 5, elements corresponding to those in FIG. 3 of the first embodiment have the same reference numerals and the explanations of the elements will be omitted.

An address decoder 360 decodes address data from the address bus 351 and outputs an enable signal for access to a sector of the flash ROM 361 corresponding to a predetermined area. The flash ROM 361 is divided into eight sectors 1 to 8. In this embodiment, the program corresponding to the program stored in the mask ROM 353 in the first embodiment is fixedly stored in the sector 1. As in the case of the first embodiment, the program stored in the sector 1 is used for the initial operation of the CPU 350 and serial communication with the printer controller 301, or flash ROM 361 rewrite control. Control is made on the program such that even in a flash ROM 361 control program rewrite mode, rewriting is not performed in this area.

A control program to control the normal printer operation is written in the sectors 2 to 7. This area is subjected to rewriting in the flash ROM 361 rewrite mode. The sector 8 is an area for storing the data written in the EEPROM 318 of the first embodiment, i.e., the information indicating whether or not the rewriting of the flash ROM 361 has successfully completed. Upon rewrite of the flash ROM 361 from the printer controller 301, rewriting is not performed in this area, however, upon completion of rewriting, the information indicating whether or not the rewriting has normally completed is individually written in this area by the program in sector 1.

In this arrangement, similar processing to that of the first embodiment can be performed only with the flash ROM 361, and further, similar advantages to those of the first embodiment can be attained.

[Third Embodiment]

Next, as a third embodiment of the present invention, serial communication between the printer controller 301 and the engine controller 302 upon execution of the flash ROM rewrite mode will be described. The serial communication is clock synchronization type communication using 16 bit data including a parity bit. In response to a command from the printer controller 301, a status is one-to-one returned from the engine controller 302. In the flash ROM rewrite mode, this physical communication format is not changed but handling of data is changed. Note that in the third embodiment, an address of the flash ROM has a length of 16 bits, and 8 bit data is handled. The hardware construction of the third embodiment will be described based on that of the above-described first embodiment (FIGS. 2 and 3), however, it may be based on that of the second embodiment.

The 16 bit address is divided into two 8 bit address data, and transmitted from the printer controller 301 to the engine controller 302 by two communications. Thereafter, 8 bit data to be stored at the address is transmitted. When a status indicating the completion of rewriting has been returned from the engine controller 302 to the printer controller 301, the same address is read again. At this time, the 16 bit address is divided into two 8 bit address data, and the data at the address is returned to a status corresponding to the second half of address set command. This enables a verify operation. The rewriting operation is sequentially performed in this manner.

Figure 6:
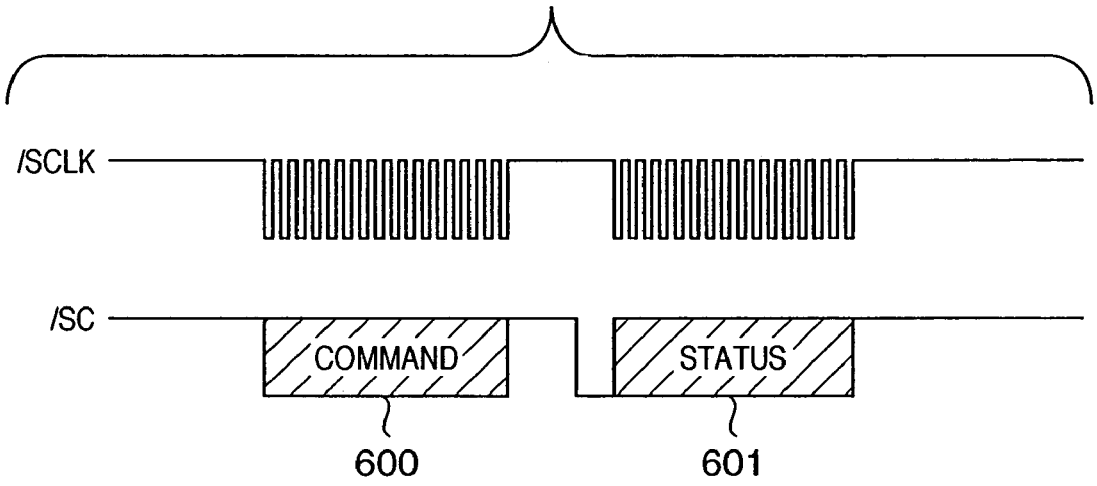
FIG. 6 is a timing chart showing serial communication between a printer controller and the engine controller according to a third embodiment.

FIG. 6 depicts a timing chart of the serial communication.

A status line (/SC) works as a command and a status. A serial clock (/SCLK) is outputted from the printer controller 301 to the engine controller 302.

In response to 16 bit command data 600 outputted from the printer controller 301, 16 bit status data 601 is returned from the engine controller 302. At this time, the timing of status returning on the engine controller 302 can be recognized by the printer controller 301 by temporarily changing the status line to a low level.

FIG. 7 depicts an example of bits of the 16 bit command data and data in the flash ROM 354 rewrite mode according to the third embodiment.

The 16 bit data is sequentially outputted from the most significant bit (MSB) in synchronization with the serial clock (/SCLK). The 16 bit command and data is comprised of 8 bit data (bits 8 to 15), 6 bit (bits 2 to 6) command code designating a command type and 1 bit (MSB=1) indicating that the command is a command in the flash ROM 354 rewrite mode, and an odd parity bit (LSB).

FIG. 8 shows an example of bits of the 16 bit status data according to the third embodiment.

The status data is comprised of 8 bit data (bits 8 to 15), a 6 bit status code (bits 2 to 7), and an odd parity bit (LSB). The MSB of the status data is always "0".

FIG. 9 shows the relation between commands and statuses in the flash ROM 354 rewrite mode according to the third embodiment.

In FIG. 9, commands CMD0 to CMD2 are used by the printer controller 301 to cause the engine controller 302 to enter the flash ROM 354 control program rewrite mode. The commands are sequentially issued in numerical order (CMD0→CMD1→CMD2), and if all the commands are normally received, the engine controller 302 enters the flash ROM 354 control program rewrite mode. When the engine controller 302 has entered the flash ROM 354 control program rewrite mode, other commands than those registered in the table of FIG. 9 are not accepted. Further, in the normal printer operation mode, other commands than a command CMD0 are not accepted.

If the command CMD0 has been received, only the command CMD1 is continuously received. If other command than the command CMD1 has been received, the history of past reception of the command CMD0 is cancelled. In this manner, erroneous transition to the flash ROM 354 control program rewrite mode is prevented.

Further, in FIG. 9, a command CMD11 is issued to request the engine controller 302 to show the percentage (rate: %) of updated addresses of the flash ROM 354 to the total addresses to be updated. When this command has been received, the engine controller 302 returns 8 bit data indicating the percentage of the addresses in which program data has been written, as decimal data expressing 0 to 100%, by 1%, to the printer controller 301. In accordance with this status, the printer controller 301 recognizes the remaining area during rewriting of the control program in the flash ROM 354 in the engine controller 302, and can notify the information to a user via the display panel 320 of the printer or a printer driver of the host computer 319.

Note that in FIG. 9, a command code and a status code in corresponding positions (line) are a command and a response status to the command. The corresponding command code and the status code have the bit arrangement as shown in FIGS. 7 and 8.

Figure 10:
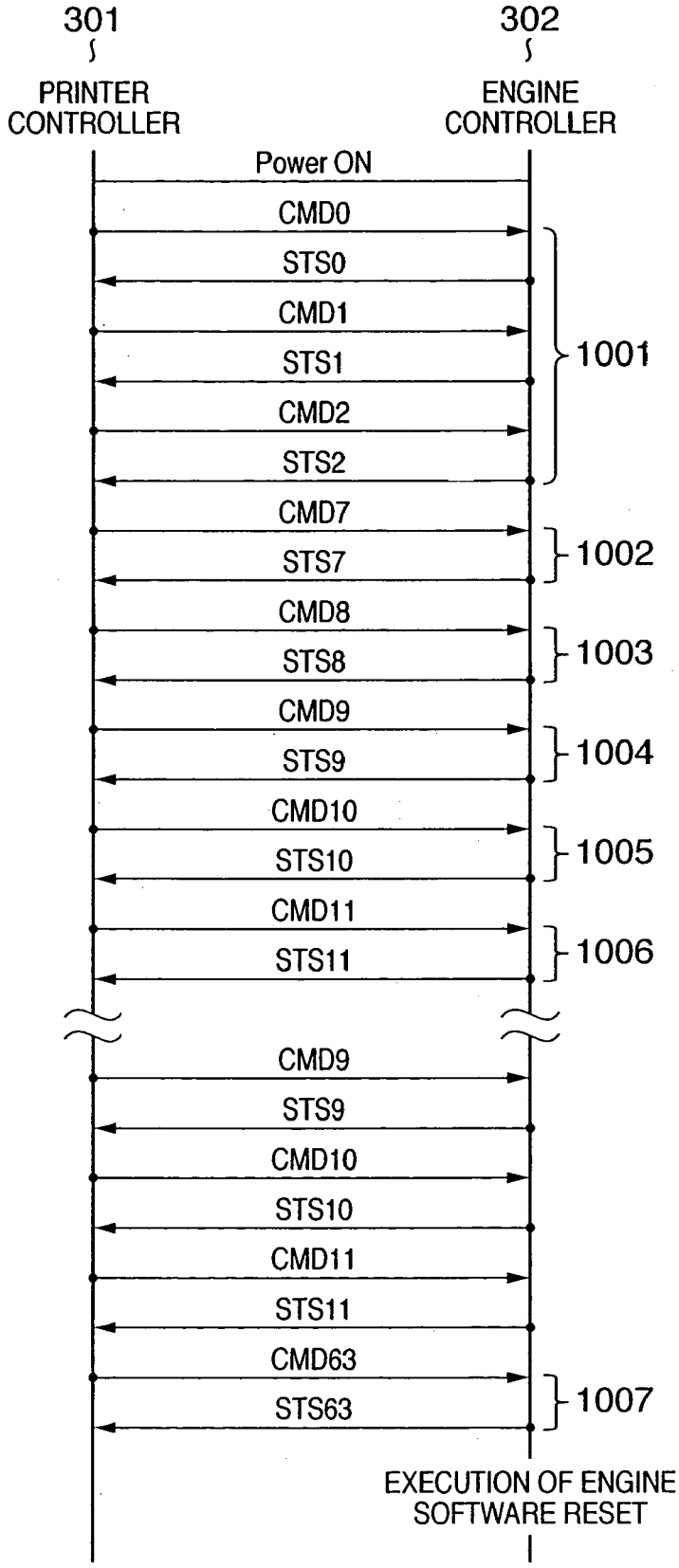
FIG. 10 is a timing chart showing signals between the printer controller and the engine controller according to the third embodiment.

FIG. 10 depicts a sequence of transmission of commands and statuses between the printer controller 301 and the engine controller 302 according to the third embodiment.

In FIG. 10, at 1001, the commands CMD0 to CMD2 are continuously outputted from the printer controller 301, to cause the engine controller 302 to enter the flash ROM 354 rewrite mode. At 1002, the printer controller 301 designates a write address (higher 8 bits) of the flash ROM 354 and at 1003, designates a write address (lower 8 bits) of the flash ROM 354. After the 16 bit address has been designated at 1002 and 1003, 8 bit data to be written to the address is sent from the printer controller 301 to the engine controller 302 at 1004. At 1005, a verify request is made for the written data, and at 1006, an inquiry as to the percentage of the address in the entire address is made from the printer controller 301 to the engine controller 302. The designation of address (1002 and 1003) and designation of data (1004) to be written to the address are repeatedly performed as described above, and when all the data has been written in the flash ROM 354, a request for software reset of the printer engine is made at 1007. By this request, software reset processing is performed on the printer engine by the engine controller 302.

Figure 11:
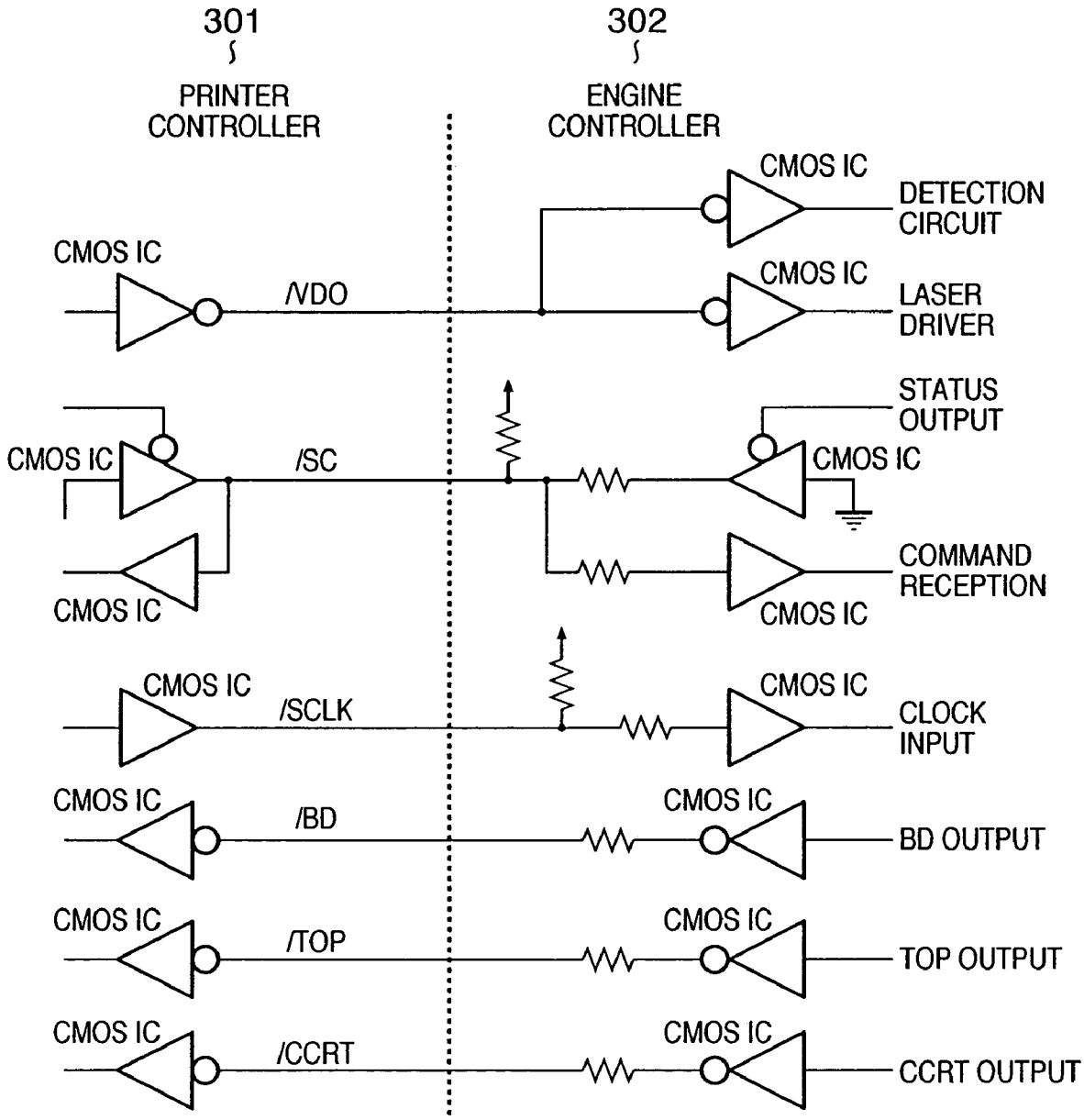
FIG. 11 is a schematic diagram showing signal driver circuits between the printer controller and the engine controller according to the third embodiment.

Further, FIG. 11 depicts an example of signal driver circuits for serial signals between the printer controller 301 and the engine controller 302.

[Other Embodiment]

The present invention can be applied to a system constituted by a plurality of devices (e.g., a host computer, an interface, a reader and a printer) or to an apparatus comprising a single device (e.g., a copy machine or a facsimile apparatus).

Further, the object of the present invention can also be achieved by providing a storage medium (or recording medium) holding software program code for performing the aforesaid processes to a system or an apparatus, reading the program code with a computer (e.g., CPU, MPU) of the system or apparatus from the storage medium, then executing the program.

In this case, the program code read from the storage medium realizes the functions according to the embodiments, and the storage medium holding the program code constitutes the invention.

Further, the storage medium, such as a floppy disk, a hard disk, an optical disk, a magneto-optical disk, a CD-ROM, a CD-R, a DVD, a magnetic tape, a non-volatile type memory card, and ROM can be used for providing the program code.

Furthermore, besides aforesaid functions according to the above embodiments are realized by executing the program code which is read by a computer, the present invention includes a case where an OS (operating system) or the like working on the computer performs a part or entire actual processing in accordance with designations of the program code and realizes functions according to the above embodiments.

Furthermore, the present invention also includes a case where, after the program code read from the storage medium is written in a function expansion card which is inserted into the computer or in a memory provided in a function expansion unit which is connected to the computer, CPU or the like contained in the function expansion card or unit performs a part or entire process in accordance with designations of the program code and realizes functions of the above embodiments.

The present invention is not limited to the above embodiments and various changes and modifications can be made within the spirit and scope of the present invention. Therefore, to appraise the public of the scope of the present invention, the following claims are made.

What is claimed is:

1. An image forming apparatus having a control unit to control an image forming process, comprising:

a first memory configured to store a control program executed by the control unit in a nonvolatile manner;

control transition means for, in a case where update of the control program stored in said first memory is requested, changing control to that based on a program stored in a second memory;

writing means for receiving a control program as a subject of update and writing the control program into said first memory under the control of the program stored in the second memory; and means for, when writing by said writing means has ended and the update of the control program in said first memory has been completed, changing the control by the control unit to the control based on the control program written into said first memory by said writing means, wherein said first memory is a flash ROM, and the second memory is a customized mask ROM.

2. The image forming apparatus according to claim 1, wherein the control unit has an engine controller to control mechanical components for the image forming process and a printer controller to control reception of print data and development of the print data to image data, wherein the control program as the subject of update is received by the printer controller then sent to the engine controller and written into said first memory.

3. The image forming apparatus according to claim 1, further comprising a nonvolatile memory storing information indicating whether or not the writing by said writing means has ended and the update of said first memory has been normally completed.

4. A program update method in an image forming apparatus having a control unit to control an image forming process, comprising:

a control transition step of, in a case where update of a control program stored in a first memory is requested, changing control to a control based on a program stored in a second memory;

a writing step of receiving a control program as a subject of update and writing the control program into the first memory under the control of the program stored in the second memory; and a step of, when writing in said writing step has ended and the update of the control program in the first memory has been completed, changing the control by the control unit to the control based on the control program written into the first memory in said writing step, wherein the first memory is a flash ROM, and the second memory is a customized mask ROM.

5. The program update method according to claim 4, wherein the image forming apparatus has an engine controller to control mechanical components for the image forming process and a printer controller to control reception of print data and development of the print data to image data, wherein the control program as the subject of update is received by the printer controller then sent to the engine controller and written into the first memory.

6. The program update method according to claim 4, further comprising a step of storing information indicating whether or not the writing in said writing step has ended and the update of the first memory has been normally completed into a nonvolatile memory.

* * * * *